US009969204B2

(12) United States Patent
Miller

(10) Patent No.: US 9,969,204 B2
(45) Date of Patent: May 15, 2018

(54) CLIPBOARD DEVICE WITH ELASTIC RETAINER

(71) Applicant: Loren L. Miller, Los Alamitos, CA (US)

(72) Inventor: Loren L. Miller, Los Alamitos, CA (US)

(73) Assignee: HOM Essence, Los Alamitos, CA (US)

( * ) Notice: Subject to any disclaimer, the term of this patent is extended or adjusted under 35 U.S.C. 154(b) by 199 days.

(21) Appl. No.: 14/533,750

(22) Filed: Nov. 5, 2014

(65) Prior Publication Data

US 2015/0128381 A1 May 14, 2015

Related U.S. Application Data

(60) Provisional application No. 61/900,183, filed on Nov. 5, 2013.

(51) Int. Cl.
*B42F 9/00* (2006.01)

(52) U.S. Cl.
CPC ..... *B42F 9/001* (2013.01); *B42F 9/005* (2013.01); *Y10T 24/202* (2015.01)

(58) Field of Classification Search
CPC ..... B42F 9/001; B42F 9/005; A47B 23/043; A47B 23/042
USPC ..... 24/673, 67.3; 281/45
See application file for complete search history.

(56) References Cited

U.S. PATENT DOCUMENTS 71,635 A * 12/1867 Parsons ..... A41H 37/04 227/141
297,284 A * 4/1884 Mudgett ..... A47B 23/042 248/452
680,173 A * 8/1901 Paulsen ..... B42F 9/001 211/51
889,743 A * 6/1908 Avis ..... B42F 13/402 281/33
1,317,423 A * 9/1919 Bottle ..... A47B 9/00 108/12
1,416,903 A * 5/1922 Stalling ..... B42D 9/082 281/45
1,909,807 A * 5/1933 Buxton ..... B42F 13/04 206/37
2,081,875 A * 5/1937 Ross ..... B42F 13/402 281/33
2,614,567 A * 10/1952 Kinney ..... B42F 13/0093 281/23
2,807,908 A * 10/1957 Lykes ..... A47B 23/007 248/451
3,097,444 A * 7/1963 Steiner ..... A47B 23/043 248/454
3,747,889 A * 7/1973 Gerald ..... B42D 17/00 248/451
3,951,374 A * 4/1976 Quigley ..... A47B 23/042 248/444
4,199,173 A * 4/1980 Greenlees ..... B42F 9/001 24/457
4,296,946 A * 10/1981 Larre ..... A47B 23/043 248/451

(Continued)

*Primary Examiner* — Jason W San
(74) *Attorney, Agent, or Firm* — Robert D. Buyan; Stout, Uxa & Buyan, LLP

(57) ABSTRACT

A clipboard device having an elastic retainer member which is alternately deployable to hold papers or other items in place on the front or rear surface of the clipboard and related methods of manufacture and use.

6 Claims, 8 Drawing Sheets

(56) References Cited

U.S. PATENT DOCUMENTS 4,318,527 A * 3/1982 Smith ..... A47B 23/044 248/459
4,378,102 A * 3/1983 Portis, Jr. ..... A47B 23/06 248/165
4,462,614 A * 7/1984 Krause ..... B42D 9/005 281/42
4,512,603 A * 4/1985 Williams ..... A47B 23/00 248/451
4,555,128 A * 11/1985 White ..... A47B 23/043 248/451
4,586,730 A * 5/1986 Shulyak ..... B42D 19/00 248/444
4,596,333 A * 6/1986 Gilreath ..... B42F 1/00 211/51
4,620,687 A * 11/1986 Bishop ..... A47B 23/06 248/447.2
4,655,427 A * 4/1987 Lamb ..... B42D 9/005 248/444.1
4,726,607 A * 2/1988 White ..... B42D 17/00 211/86.01
4,750,657 A * 6/1988 King ..... B43L 5/02 224/220
D298,955 S * 12/1988 Zovar ..... D19/88
4,903,932 A * 2/1990 Stewart, Jr. ..... A45F 5/00 224/267
4,978,096 A * 12/1990 Struckmann ..... A47B 23/043 24/18
5,035,393 A * 7/1991 Menaged ..... A47B 23/043 248/456
5,150,785 A * 9/1992 Kelley ..... A63B 71/00 206/217
D330,916 S * 11/1992 Wolfe ..... D19/86
5,165,648 A * 11/1992 Quigley ..... A47B 23/042 248/444
5,165,722 A * 11/1992 Wong ..... B42D 9/00 24/679
5,690,309 A * 11/1997 Blum ..... A47B 23/041 248/444
5,722,628 A * 3/1998 Menaged ..... A47B 23/043 211/50
5,823,500 A * 10/1998 La Coste ..... B43L 3/008 248/444
5,829,787 A * 11/1998 Newhouse, Jr. ..... B42D 17/00 248/444.1
6,641,171 B2 * 11/2003 Lin ..... B42F 13/402 229/67.1
6,971,616 B1 * 12/2005 Lake ..... B42F 9/001 24/67.3
7,017,878 B2 * 3/2006 Guo ..... B60N 3/005 108/42
8,517,330 B1 * 8/2013 Joyce ..... B42F 9/001 24/67.3
8,925,722 B2 * 1/2015 Poon ..... F16M 13/00 206/320
2002/0180205 A1 * 12/2002 Anderson ..... B42F 9/005 281/45
2003/0155762 A1 * 8/2003 Gaska ..... B42F 9/005 281/45
2004/0069921 A1 * 4/2004 Shepard ..... B42D 5/043 248/444
2005/0179248 A1 * 8/2005 Isenberg ..... B42D 17/005 281/45
2006/0255584 A1 * 11/2006 Han ..... B42F 9/005 281/45
2008/0002394 A1 * 1/2008 Jones ..... B42F 9/004 362/99
2009/0127309 A1 * 5/2009 Wilcox ..... A45C 13/30 224/579
2009/0301919 A1 * 12/2009 Pascale ..... B42F 9/001 206/459.1
2010/0084848 A1 * 4/2010 Nguyen ..... B42F 9/001 281/49
2010/0139050 A1 * 6/2010 Kelly ..... B42F 9/001 24/67.5
2010/0236452 A1 * 9/2010 Ruddy ..... B43L 3/008 108/6
2011/0259690 A1 * 10/2011 Clayton ..... B42F 9/002 190/109
2012/0164610 A1 * 6/2012 Pascale ..... B43K 23/001 434/159
2014/0346201 A1 * 11/2014 Raeburn ..... B42F 9/001 224/250
2015/0048610 A1 * 2/2015 Harris ..... B42D 1/007 281/45
2015/0143670 A1 * 5/2015 Lin ..... B42F 9/001 24/67.7
2016/0015141 A1 * 1/2016 Feinberg ..... A47B 23/042 206/45.24
2016/0167423 A1 * 6/2016 Carroll ..... B42F 9/002 281/45

* cited by examiner

CLIPBOARD DEVICE WITH ELASTIC RETAINER

RELATED APPLICATION

This application claims priority to U.S. Provisional Patent Application No. 61/900,183 entitled Clipboard Device With Elastic Retainer filed Nov. 5, 2013, the entire disclosure of which is expressly incorporated herein by reference.

FIELD OF THE INVENTION

The present invention relates generally to mechanical devices and more particularly to a clipboard device having an elastic retainer useable for securing papers and/or holding other articles.

BACKGROUND

The prior art has included a number of clipboard devices having clips, clamps and other apparatus for holding papers and/or other articles (e.g., pens, pencils, envelopes, etc.) on the clip board.

For example, U.S. Pat. No. 6,971,616 (Lake) describes a clipboard comprising a planar board member with clamping mechanism that includes at least one biasing element and a clamping element. The clamping element has at least one paper clamp cooperating with a holding element. The planar board member has at least one slot for penetration of the paper clamp through the planar board member from the rear face of the planar board to the front face. A writing implement holder and a carrying handle may be incorporated into the clamping mechanism. Also, notches may be formed directly opposite one another in the side edges of the planar board, near its bottom end, for holding elastic bands such the elastic bands extend in parallel around the planar board member, near its bottom end.

There remains a need in the art for the development of new clipboard devices having elastic retainer(s) which are designed to not only prevent wind from blowing papers that are attached to the clip board but also to facilitate attachment of other articles of varying width to the clipboard.

SUMMARY OF THE INVENTION

In accordance with the present invention, there is provided a clipboard device which comprises a) a substantially planar board member having a top end, a bottom end, a right side edge, a left side edge, a front surface and a back surface, b) an elastic retainer member having first and second ends, the first and second ends of the elastic retainer member being anchored or attached to the board member at spaced-apart locations at or near the top end of the board member and c) an elastic retainer member engaging structure at or near the bottom end of the board member, a mid-region of the elastic retaining member being alternately engageable and disengageable with the engaging structure. When the mid-region of the elastic retaining member is engaged with the engaging structure, first and second portions of the elastic retaining member traverse substantially from top to bottom over the front or alternately the back surface of the board member, with said first and second elastic retainer member portions being closer together at the bottom than at the top of the board member.

Further in accordance with the present invention, there is provided a method for using a clipboard device of the foregoing character by placing an article adjacent to either the front or back surface of the board member and causing the elastic retaining member to become engaged with the engaging structure and positioned such that the elastic retaining structure holds the article substantially in place.

Still further in accordance with the invention, there is provided a method for storing an item on a clipboard device which comprises a substantially planar board member having a front surface, a rear surface, a bottom end, a top end and an elastic retaining member attached thereto, said method comprising the steps of a) deploying the elastic retaining member in a stretched configuration over either the front surface or back surface of the board member, b) engaging a mid-portion of the elastic retaining member with an engagement structure located at or near a bottom end of the board member such that first and second portions of the elastic retaining member traverse substantially from top to bottom over the front or alternately the back surface of the board member, with said first and second elastic retainer member portions being closer together at the bottom than at the top of the board member and c) causing paper or other article(s) to be positioned under either of both of the first and second portions of the elastic retaining member so as to hold the paper or other article(s) against the front or back surface of the board member.

Further aspects and details of the present invention will be understood by those of skill from the accompanying drawings and detailed description set forth below.

DETAILED DESCRIPTION

Figure 1:
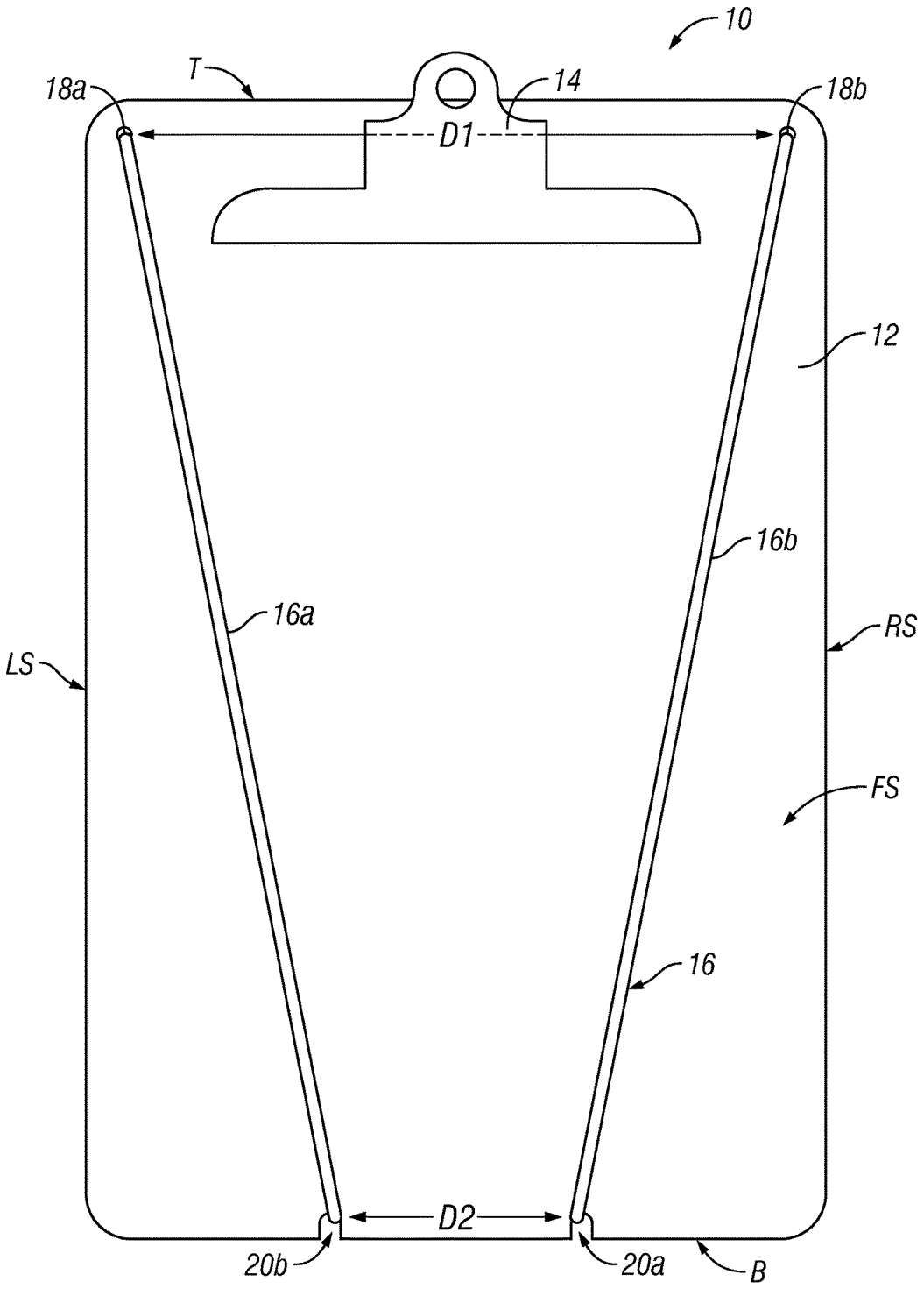
FIG. 1 is a front view of one embodiment of a clip board device of the present invention while its elastic retainer member is operatively deployed over the front surface of the clipboard.

The following detailed description and the accompanying drawings to which it refers are intended to describe some, but not necessarily all, examples or embodiments of the invention. The described embodiments are to be considered in all respects only as illustrative and not restrictive. The contents of this detailed description and the accompanying drawings do not limit the scope of the invention in any way.

The embodiment of the invention shown in accompanying FIGS. 1-4 generally comprises a clipboard device 10 having a board member 12 with a clip 14 and an elastic retainer member 16. The elastic retainer member 16 may be any suitable elastic cord, elastic band, elastic strand or other elongate elastic material. The board member 12 has a top end T, a bottom end B, a right side edge RS, a left side edge LS, a front surface FS and a back surface BS. The elastic retainer member 16 is attached to the device 10 and useable to hold down papers that are clipped to the board member by way of the clip 14 and/or for attaching ancillary articles (e.g., calculators, writing instruments, pens, pencils, high-lighters, markers, envelopes, folded papers, notes, cell phones, etc.).

As shown, the first and second ends of the elastic retainer member 16 are anchored or attached to the board member 12 at spaced-apart locations at or near the top end T of the board member 12. In this example, these first and second locations are separated by distance D1. At or near the bottom end B of the board member 12 is an engaging structure constructed to engage and hold the mid-region 16mid of the elastic retaining member 16 when the elastic retaining member 16 is stretched downwardly and its mid-region 16 mid placed over such retaining structure. In the non-limiting example shown in the drawings, this engaging structure comprises a section of the board member 12 of width D2 located between first and second notches 20*a*, 20*b* formed in the bottom end B of the board member 12. It is to be appreciated that in other embodiments, this engaging structure may be any suitable hook, projection, tab, or other structure over which the elastic retaining member mid-region 16mid may be passed.

Figure 2:
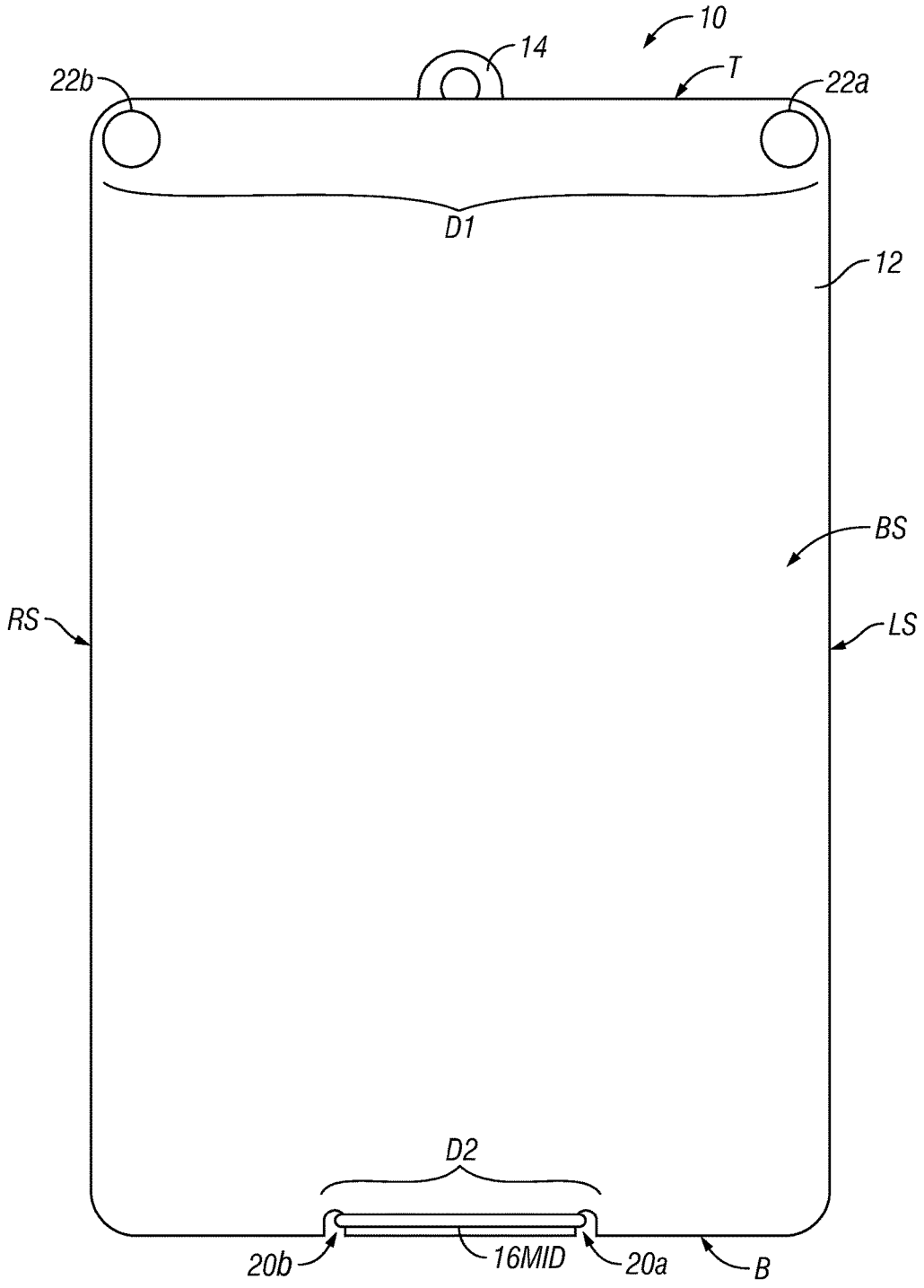
FIG. 2 is a rear view of the embodiment of FIG. 1 while its elastic retainer member is operatively deployed over the front surface of the clipboard.

As seen in FIGS. 1 and 2, when the elastic retaining member 16 is deployed adjacent to the front surface FS of the board member 12, the mid-region 16mid of the elastic retaining member 16 may be grasped, pulled downwardly and seated within notches 20*a*, 20*b* such that the mid-region 16mid extends around the back surface BS of the board member 12 between the notches 20*a*, 20*b*. This holds the elastic retaining member 16 in a stretched state with first and second portions 16*a*, 16*b* of the elastic retaining member 16 traversing substantially from top T to bottom B over the front surface FS of the board member 12. These first and second elastic retainer member portions 20*a*, 20*b* are closer together at their bottoms than at their tops, thereby forming a generally V shaped configuration over the front surface FS of the board member 12.

Figure 3:
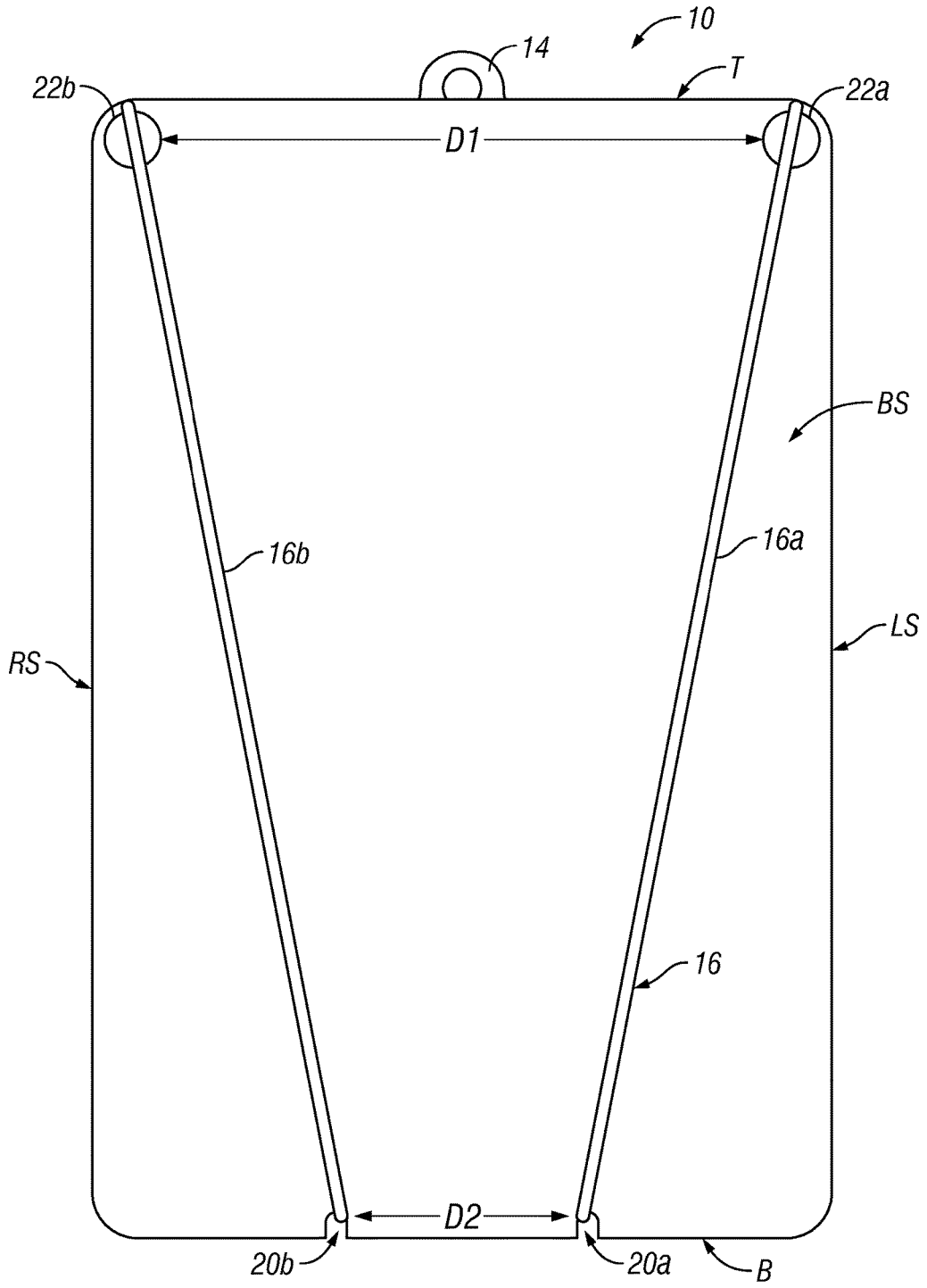
FIG. 3 is a rear view of the embodiment of FIG. 1 after movement of its elastic retainer member to an alternative position wherein it is operatively deployed over the back surface of the clipboard.

As seen in FIG. 3, the elastic retaining member 16 may alternately be positioned to hold papers or articles adjacent to the back surface BS of the board member 12. To accomplish this, with the mid-region 16mid disengaged from notches 20*a*, 20*b*, the elastic retaining member 16 is inverted over the top edge T of the board member 12 such that it becomes re-positioned adjacent to the back surface BS of the board member 12. The elastic retaining member 16 is then stretched downwardly and its mid-region 16mid re-engaged with the notches 20*a*, 20*b* such that it extends around the front surface FS of the board member 12 between the notches 20*a*, 20*b* in the manner seen in FIG. 3. This causes stretching of the elastic retaining member 16 such that first and second portions 16*a*, 16*b* of the elastic retaining member 16 traverse substantially from top T to bottom B over the front surface FS of the board member 12, with said first and second elastic retainer member portions 20*a*, 20*b* being closer together near the bottom B than near the top T. This results in the elastic retaining member 16 being deployed in a generally V shaped configuration over the front surface FS of the board member 12. The elastic retaining member 16 may be attached to the board member 12 in any suitable way. In the non-limiting example shown in the drawings, first and second apertures 18*a*, 18*b* are formed at spaced-apart locations separated by distance D1, near the top edge T of the board member 12. A first end of the elastic retaining member 16 extends, from front to back, through the first aperture 18*a* and a first anchor member 22*a* is formed on or attached to the first end of the elastic retaining member 16 to prevent it from being pulled back through the first aperture 18*a*. The opposite end (i.e. the second end) of the elastic retaining member 16 extends, from front to back, through the second aperture 18*b* and a second anchor member 22*b* is formed on or attached to the second end of the elastic retaining member 16 to prevent it from being pulled back through the second aperture 18*b*. The anchor members 22*a*, 22*b* may be discs, balls, bulbs, bars, cross members, rings, knots, masses or any other suitable shapes or objects that are too large in cross dimension to pass through apertures 18*a*, 18*b*.

Because the first and second elastic retaining member portions 16*a*, 16*b* converge such that they are closer together at the bottom than at the top (e.g., forming generally a V shape), they may be used to hold articles of varying size or width. Also, they may be spaced far enough apart at the top (distance D1) to not obstruct the top half of a paper that is attached to the clipboard device 10 by clip 14 while converging inwardly so as to hold down the outer edges of the bottom portion of the paper, thereby preventing the paper from being blown by wind or otherwise inadvertently lifted away from the board member 12. The inset within FIG. 4 shows four (4) examples of the many possible uses of the elastic retaining member 16.

Figure 4:
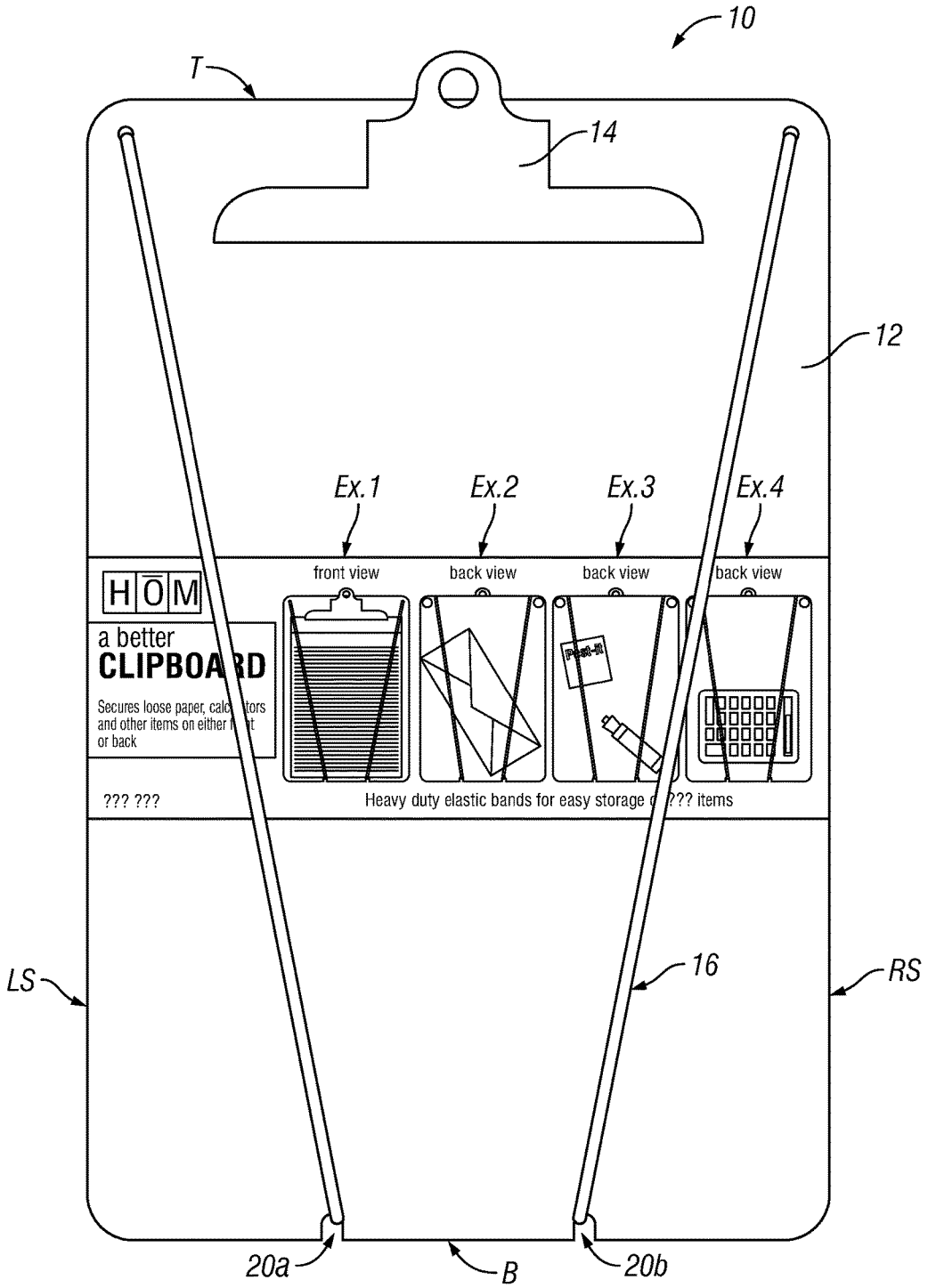
FIG. 4 is a front view of the embodiment of FIG. 1 with a label showing four non-limiting examples (Ex. 1 through Ex. 4) of ways in which the elastic retainer member of the clipboard device is useable.
Figure 5:
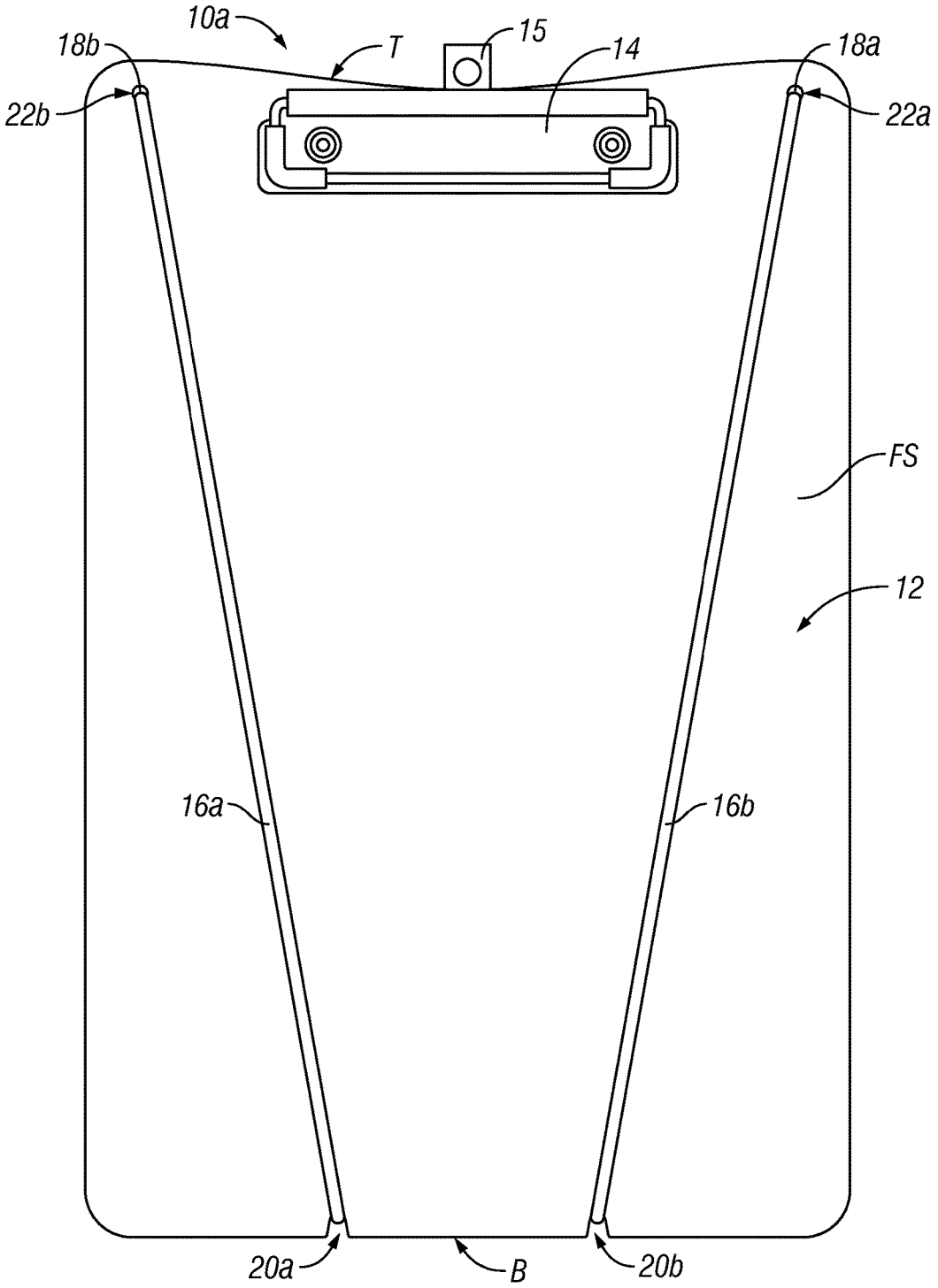
FIG. 5 is a front view of another embodiment of a clip board device of the present invention while its elastic retainer member is operatively deployed over the front surface of the clipboard.
Figure 6:
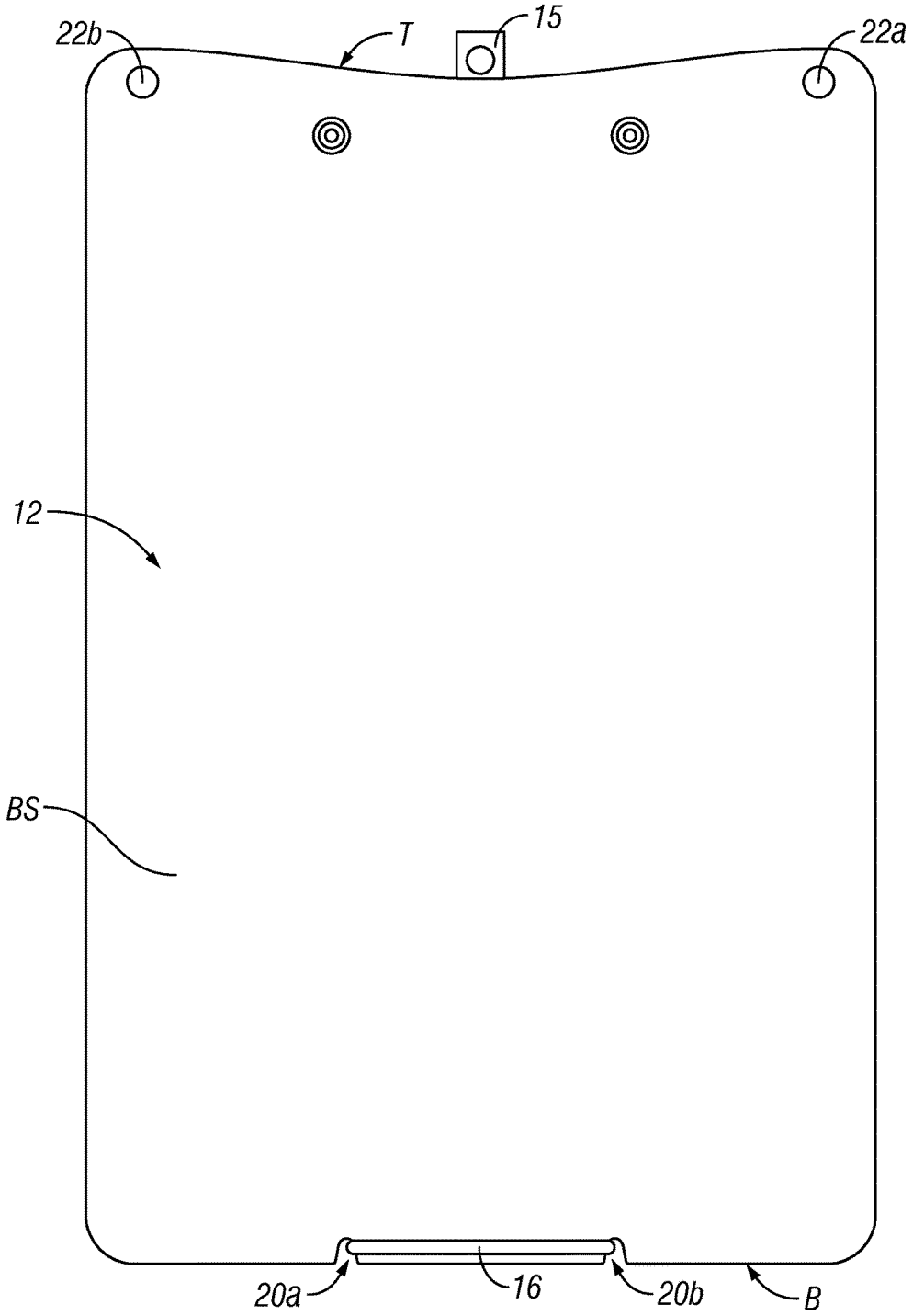
FIG. 6 is a rear view of the embodiment of FIG. 5 while its elastic retainer member is operatively deployed over the front surface of the clipboard.
Figure 7:
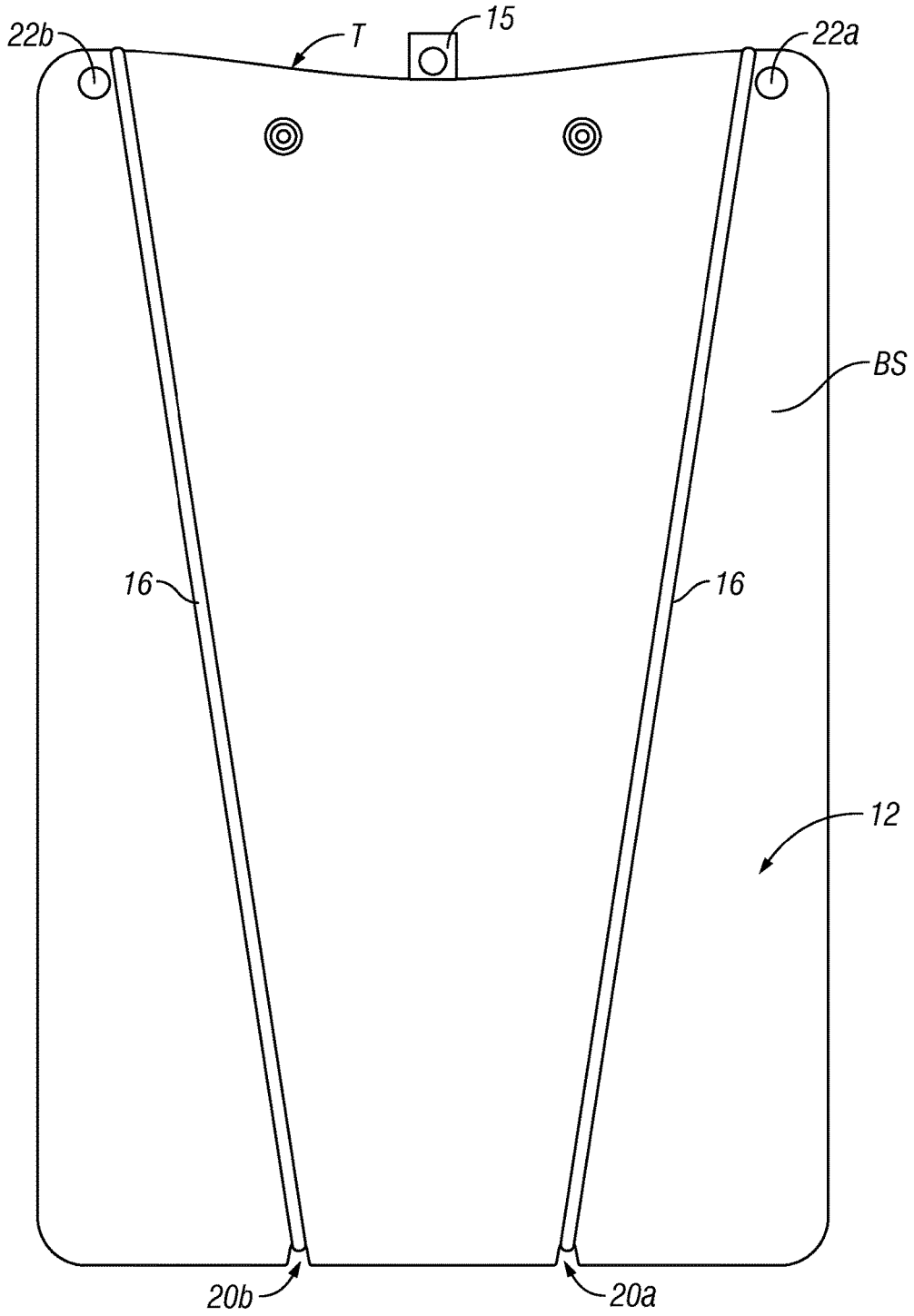
FIG. 7 is a rear view of the embodiment of FIG. 5 after movement of its elastic retainer member to an alternative position wherein it is operatively deployed over the back surface of the clipboard.

Example 1 (Ex. 1), seen in FIG. 4, depicts a front view of the device 10 with lined paper attached to the front surface FS of the board member 12 by the clip 14, with the elastic retaining member 16 operatively deployed over the front surface FS of the board member 12 in the manner shown in FIG. 1. In this example the elastic retaining member 16 holds the edges of the lined paper firmly against the front surface FS of the board member 12. Additionally, various other article(s) (e.g., calculators, writing instruments, pens, pencils, high-lighters, markers, envelopes, folded papers, notes, cell phones, etc.). may also be inserted under one or both stretched portions 16*a*, 16*b* of the elastic retaining member 16 to hold such article(s) in contact with the device when desired, such as during storage, transport and the like.

Example 2 (Ex. 2), seen in FIG. 4, depicts a rear view of the device 10 with the elastic retaining member 16 operatively deployed over the back surface BS of the board member 12 in the manner shown in FIG. 3. In this example, an envelope is positioned diagonally under the retaining member 16 such that the first portion 16*a* of the retaining member 16 holds the lower left corner of the envelope against the back surface BS of the board member 12 and the second portion 16*b* of the retaining member 16 holds the upper right corner of the envelope against the back surface BS of the board member 12. In this manner the envelope is stowed and securely attached to the back surface BS of the board member while allowing a user to freely write on or read from any papers that may be attached to the front surface FS of the board member 12 by way of clip 14.

Example 3 (Ex. 3), seen in FIG. 4, also depicts a rear view of the device 10 with the elastic retaining member 16 operatively deployed over the back surface BS of the board member 12 in the manner shown in FIG. 3. In this example, a packet of adhesive note paper is held against the back surface BS of the board member 12 by way of the first portion 16*a* of the elastic retaining member 16 and a marker is separately held against the back surface BS of the board member 12 by the second portion 16*b* of the retaining member 16. In this manner the packet of adhesive note paper and the marker are stowed and securely attached to the back surface BS of the board member while allowing a user to freely write on or read from any papers that may be attached to the front surface FS of the board member 12 by way of dip 14.

Example 4 (Ex. 4), seen in FIG. 4, also depicts a rear view of the device 10 with the elastic retaining member 16 operatively deployed over the back surface BS of the board member 12 in the manner shown in FIG. 3. In this example, a calculator is held against the back surface BS of the board member 12 by the lower aspects of both the first portion 16*a* and second portion 16*b* of the elastic retaining member 16. In this manner the calculator is stowed and securely attached to the back surface BS of the board member while allowing a user to freely write on or read from any papers that may be attached to the front surface FS of the board member 12 by way of clip 14.

FIGS. 5 through 9 show another embodiment of a clipboard device 10*a* of the present invention. This embodiment of the device 10*a* generally includes all of the same components and elements as described above with respect to the first embodiment of the device 10. However, as explained in more detail below, this second embodiment of the device 10*a* additionally includes one or more of several optional features or components. These optional features or components include but are not limited to a) ergonomic shaping of the board member 12 to facilitate handling and function of the device 10*a*, a generally u-shaped curvature of the top edge T of the board member 12, inclusion of a retractable/extendable hanger 15 and/or the inclusion of surface groove(s) 30 and/or 32 at specific locations such that the elastic retaining member 12 will seat within such groove(s) when the elastic member 12 is in one of its operative positions.

Referring specifically to FIG. 5 through 9, in this embodiment, the board member 12 may be formed of a molded plastic material that does not deform or creep under the temperatures and conditions (e.g., indoor/outdoor, direct sunlight, ambient temperature variations, etc.) or any other suitable material.

Also, in this non-limiting example, the elastic retaining member comprises a bunge-type cord and the anchor members 22*a*, 22*b* comprise knots formed at either end of the cord. Optionally, concavities or recesses may be formed in the back surface BS of the board member 12 around the apertures 18 through which the elastic retaining member 16 extends so that, when the elastic retaining member 16 is pulled taught, the knots on either end of the retaining member 16 will seat within those concavities or recesses.

Optionally, the back surface BS of the board member 12 may be concaved or otherwise ergonomically shaped with the side edges RS, LA (or possibly the entire periphery) of the back surface BS being sloped slightly inward (i.e., toward the front surface FS) so that when a user grasps board member 12 along one of the side edges RS, LS the user's fingers will rest on a slightly sloped region of the back surface BS. Also optionally, the top end T of the board member 12 may be curved in the manner shown so that the top end T is higher at its ends than at its middle. This allows the middle of the top end T to be near or flush with the top edge of the clip 14 while the apertures 18 through which the elastic retainer member 16 extends are situated above the top edge of any paper or other flat item clipped to the front surface FS of the board member 12 by the clip 14.

Also, optionally, an extendable/retractable hanger 15 may be extendable out of and retractable into the clip 14 or into the top end T of the board member 12 at the mid-point thereof to facilitate hanging of the clipboard device 10*a* on a hook, exposed nail or other projection. In embodiments that include the optional curvature of the top end T as well as this optional extendable/retractable hanger 15, the hanger 15 may, when in its full extended position, protrude above the mid-region of the top end T, as may be appreciated from the showings of FIGS. 5 and 8.

Figure 9:
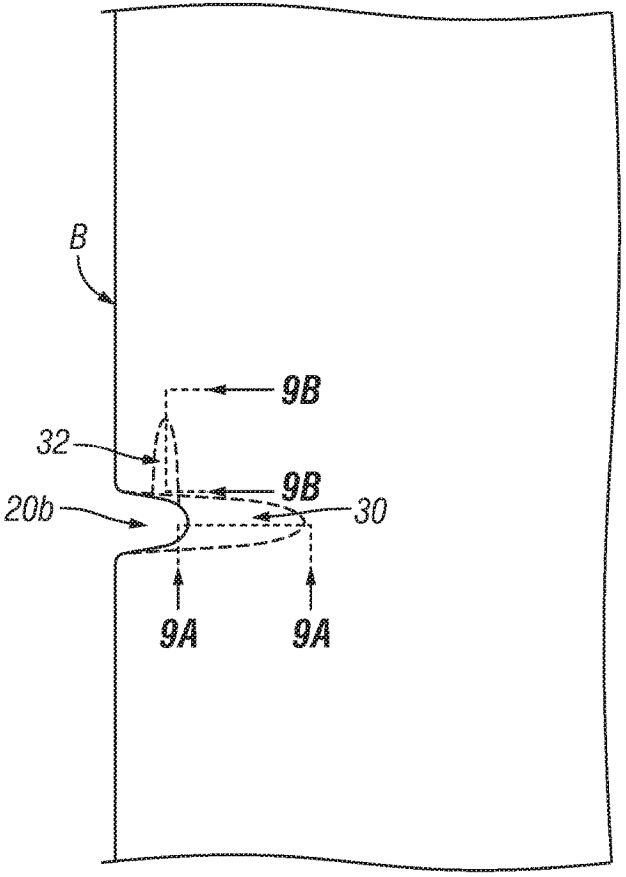
FIG. 9 is an enlarged rear view of the area around one of two elastic retainer member engaging notches formed in the bottom edge of the clipboard showing optional grooves or depressions within which the elastic retaining member seats when it is engaged with the elastic retainer member engaging notches.
Figure 9A:
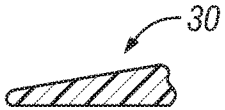
FIG. 9A is a cross-sectional view through Line 9A-9A of FIG. 9.
Figure 9B:
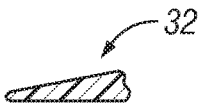
FIG. 9B is a cross-sectional view through Line 9B-9B of FIG. 9.
Figure 8:
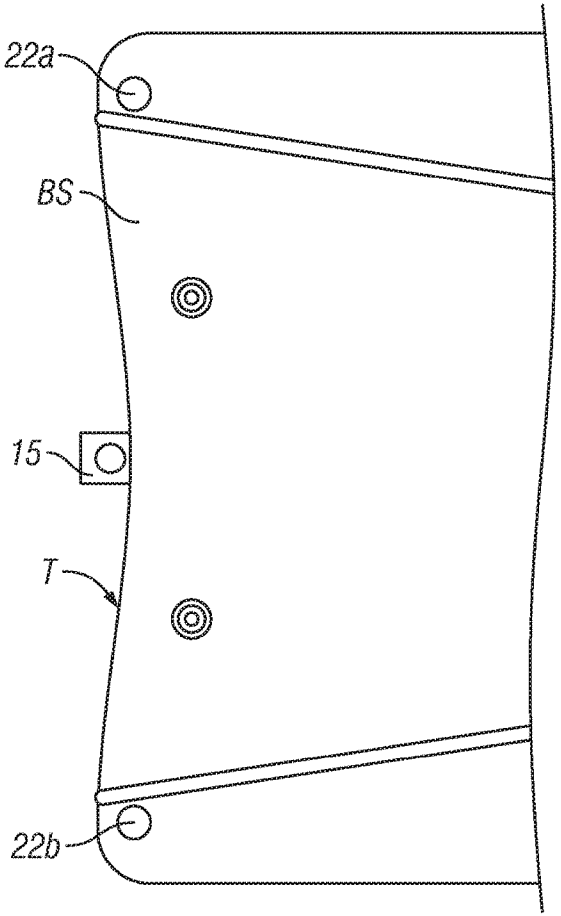
FIG. 8 is a rear view of a top portion of the embodiment of FIG. 5 with its elastic retainer hanging in a disengaged position.

Also, optionally, as may be appreciated from the close-up view of FIG. 9, locator grooves 30 and/or 32 may be formed at specific locations in the front surface FS and/or hack surface BS of the board member 12 such that portions of the elastic retainer member 12 will seat within such locator grooves 30 and/or 32. In this manner, the optional locator grooves 30 and/or 32 may guide or retain the stretched elastic retainer member portions 16*a*, 16*b* along the trajectories over the front and/or back surface of the board member 12 and/or may deter inadvertent slippage or disengagement of the mid-region of the elastic retainer member 16 from the notches 20*a*, 20*b* during use. In the non-limiting example shown, vertical grooves 30 are formed in the front surface FS of the board member 12 extending in a generally vertical directions from the engagement notches 20*a*, 20*b*. As shown in the cross-sectional view of FIG. 9A, optional vertical groves 30 ramp downwardly into the notches 20*a*, 20*b* so that, when the mid-region of the elastic retaining member 16 is engaged within notches 20*a*, 20*b*, the stretched right and left portions 16*a*, 16*b* of the retaining member 16 with seat within those vertical locator grooves 30. This helps to position and hold the right and left portions 16*a*, 16*b* of the retaining member 16 on their desired angular trajectories from top to bottom over the front surface FS of the board member 12, as shown, and additionally deters inadvertent slippage of the elastic retaining member 16 out of the notches 20*a*, 20*b*. Alternatively or additionally, one or more horizontal locator groove(s) 32 may extend horizontally between the notches 20*a*, 20*b* and may ramp downwardly into the notches 20*a*, 20*b* as shown in the cross-sectional view of FIG. 9B so that, when the when the mid-region of the elastic retaining member 16 is engaged within notches 20*a*, 20*b*, it will also seat within those horizontal locator groove(s) 30. In this manner, the optional horizontal locator grove(s) 30 may deter inadvertent slippage of the elastic retaining member 16 out of the notches 20*a*, 20*b*. Although the drawings show these optional locator groves 30, 32 formed in only the back surface BS of the board member 12, it is to be appreciated that such locator groves 30 and/or 32 may additionally, or alternatively, be formed in the front surface FS of the board member 12.

It is to be appreciated that, although the invention has been described hereabove with reference to certain examples or embodiments of the invention, various additions, deletions, alterations and modifications may be made to those described examples and embodiments without departing from the intended spirit and scope of the invention. For example, any elements, steps, members, components, compositions, reactants, parts or portions of one embodiment or example may be incorporated into or used with another embodiment or example, unless otherwise specified or unless doing so would render that embodiment or example unsuitable for its intended use. Also, where the steps of a method or process have been described or listed in a particular order, the order of such steps may be changed unless otherwise specified or unless doing so would render the method or process unsuitable for its intended purpose. Additionally, the elements, steps, members, components, compositions, reactants, parts or portions of any invention or example described herein may optionally exist or be utilized in the substantial absence of other elements, steps, members, components, compositions, reactants, parts or portions unless otherwise noted. All reasonable additions, deletions, modifications and alterations are to be considered equivalents of the described examples and embodiments and are to be included within the scope of the following claims.

What is claimed is:

1. A clipboard device comprising:

a board member having a top edge, a bottom edge opposite the top edge, a front surface and a back surface;

a clip mounted at or near the top edge and useable for clipping papers or articles on the front surface of the board member;

an elastic retaining member which has a first end attached to the board member at a first attachment location at or near the top edge and a second end attached to the board member at a second attachment location at or near the top edge, said first attachment location and said second attachment location being spaced apart by a first distance; and first and second notches formed in the bottom edge of the board member, said first and second notches being spaced apart by a second distance that is less than the first distance;

wherein the elastic retainer member, while its first and second ends remain attached at said first and second attachment locations, is alternately moveable between:

a) a first position wherein the elastic retaining member is stretched over the front surface and inserted into said first and second notches such that a mid-region of the elastic retainer member extends horizontally across a portion of the back surface between the first and second notches and first and second portions of the elastic retaining member extend from top to bottom over the front surface so as to hold papers against the front surface; and b) a second position wherein the elastic retaining member is stretched over the back surface and inserted into said first and second notches such that the mid-region of the elastic retainer member extends horizontally across a portion of the front surface between the first and second notches and the first and second portions of the elastic retaining member extend from top to bottom over the back surface so as to hold papers against the back surface.

2. A clipboard device according to claim 1 wherein when placed in the second position, the elastic retaining member passes over the top edge, is stretched downwardly over the back surface and is inserted into the first and second notches such that the mid-region extends horizontally across said portion of the front surface between the first and second notches.

3. A clipboard device according to claim 1 further comprising locator grooves formed in the front surface adjacent to the first and second notches, said locator grooves being configured such that portions of the elastic retaining member will seat within the locator grooves when the elastic retaining member is inserted to the first and second notches.

4. A clipboard device according to claim 3 wherein the locator grooves ramp downwardly into the notches.

5. A method for using a clipboard device according to claim 1, said method comprising the steps of:

placing an item against a surface of the board member selected from the front surface and the back surface; and when said item is placed against the front surface, placing the elastic retaining member in said first position to hold said item against the front surface; or when said item is placed against the back surface, placing the elastic retaining member in said second position to hold said item against the back surface.

6. A method according to claim 5 wherein the front surface is the selected surface of the board member and wherein the method further comprises:

using the clip to clip papers or articles to the front surface of the board member.

* * * * *